US011191376B2

(12) United States Patent
Nishida

(10) Patent No.: US 11,191,376 B2
(45) Date of Patent: Dec. 7, 2021

(54) DRINKING DRAMATIZATION GLASS, STORAGE MEDIUM, AND REMOTE TOAST COUNTER SYSTEM

(71) Applicant: NETAPPLI CO., LTD., Ishikawa (JP)

(72) Inventor: Makoto Nishida, Ishikawa (JP)

(73) Assignee: NETAPPLI CO., LTD., Ishikawa (JP)

( * ) Notice: Subject to any disclaimer, the term of this patent is extended or adjusted under 35 U.S.C. 154(b) by 0 days.

(21) Appl. No.: 17/276,102

(22) PCT Filed: Sep. 24, 2020

(86) PCT No.: PCT/JP2020/035887
§ 371 (c)(1),
(2) Date: May 10, 2021

(87) PCT Pub. No.: WO2021/065642
PCT Pub. Date: Apr. 8, 2021

(65) Prior Publication Data

US 2021/0330104 A1 Oct. 28, 2021

(30) Foreign Application Priority Data

Oct. 1, 2019 (JP) ..... JP2019-191516

(51) Int. Cl.
*A47G 19/22* (2006.01)

(52) U.S. Cl.
CPC .. *A47G 19/2227* (2013.01); *A47G 2019/2238* (2013.01)

(58) Field of Classification Search
CPC ..... A47G 19/025; A47G 19/2227; A47G 2019/2238; A47G 23/16; B65D 25/54; B65D 77/24
(Continued)

(56) References Cited

U.S. PATENT DOCUMENTS 8,046,941 B2 * 11/2011 Schnuckle ..... B05B 15/37 40/324
8,550,288 B2 10/2013 Briar et al.
(Continued)

FOREIGN PATENT DOCUMENTS

CN 104545239 A 4/2015
JP 2005099159 A 4/2005
(Continued)

OTHER PUBLICATIONS

International Search Report (ISR) dated Nov. 10, 2020, issued for International application No. PCT/JP2020/035887 (2 pages).

*Primary Examiner* — Don M Anderson
*Assistant Examiner* — Madison L Poos
(74) *Attorney, Agent, or Firm* — Law Office of Katsuhiro Arai

(57) ABSTRACT

A drinking dramatization glass (1) includes: a glass body (10) being a bottomed cylinder body with a top opening (11), a flat part (20) and a curved part (30) made of transparent materials; a fixing mechanism (40) for fixing, on the flat part (20), an image display device (80) with its image display surface (81) oriented in the direction of the flat part (20); and an image aspect ratio control part (200); wherein the curved part (30) has a curved surface (31) that curves along the curved part (30); the curved surface (31) has a radius of curvature R that, when an image (82) shown on the image display surface (81) is viewed from the outer side of the glass body (10) allows a virtual image (83); and the radii of curvature in vertical direction RV and in horizontal direction RH, of the curved surface (31), are different.

20 Claims, 7 Drawing Sheets

(58) Field of Classification Search
USPC ..... 215/382, 383, 390; 220/662, 663, 669, 220/676, 703
See application file for complete search history.

(56) References Cited

U.S. PATENT DOCUMENTS

| | | | |
|---|---|---|---|
| 2008/0100469 | A1 | 5/2008 | Goldburt |
| 2017/0225833 | A1 | 8/2017 | Ni |

FOREIGN PATENT DOCUMENTS

| | | | |
|---|---|---|---|
| JP | 6337256 | B1 | 6/2018 |
| JP | 6406742 | B1 | 10/2018 |
| JP | 6432960 | B1 | 12/2018 |
| JP | 6488049 | B1 | 3/2019 |

* cited by examiner

[FIG. 1]
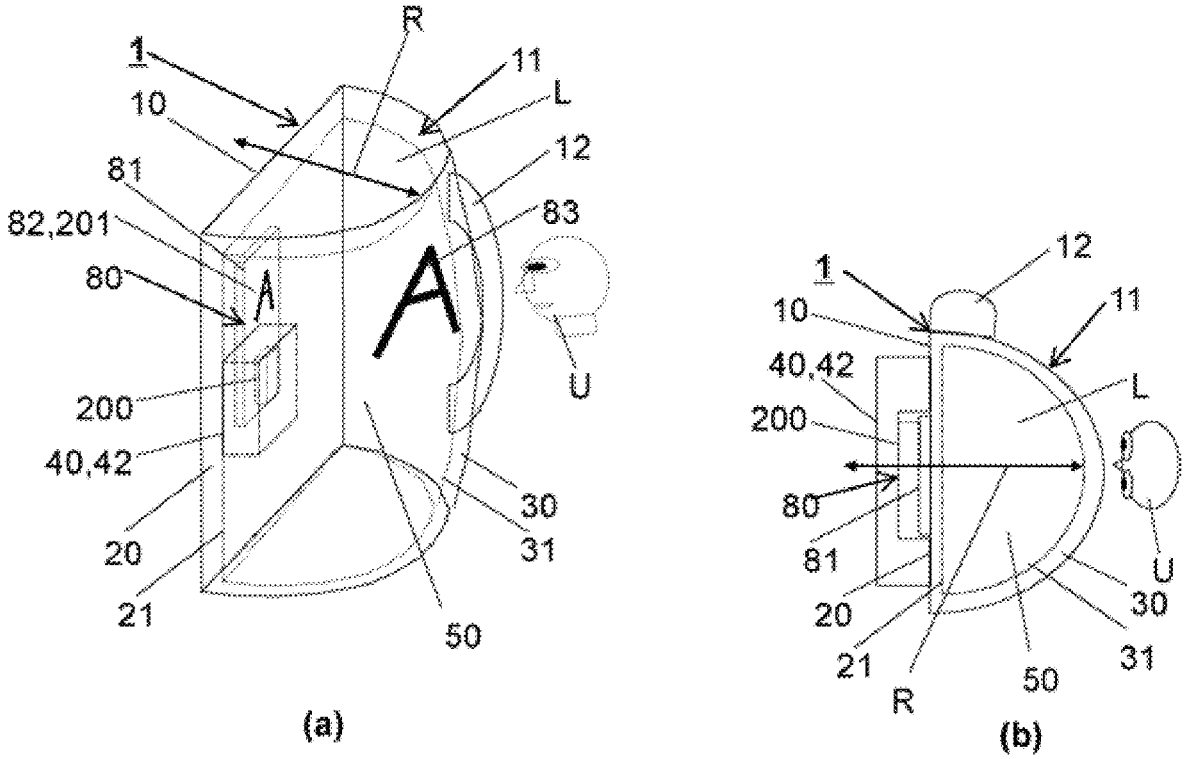
[FIG. 2]
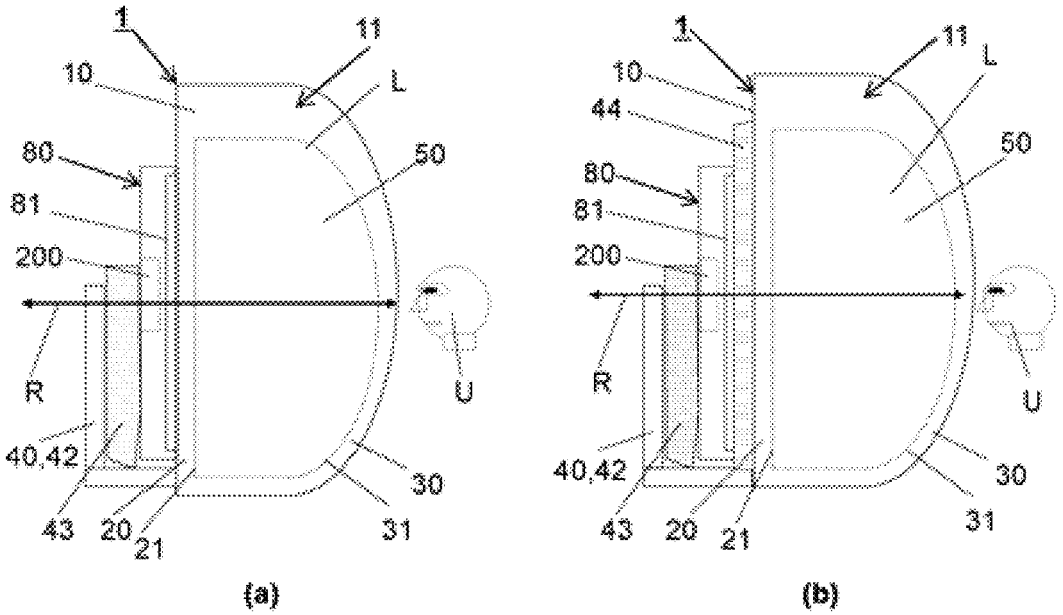

[FIG. 3]
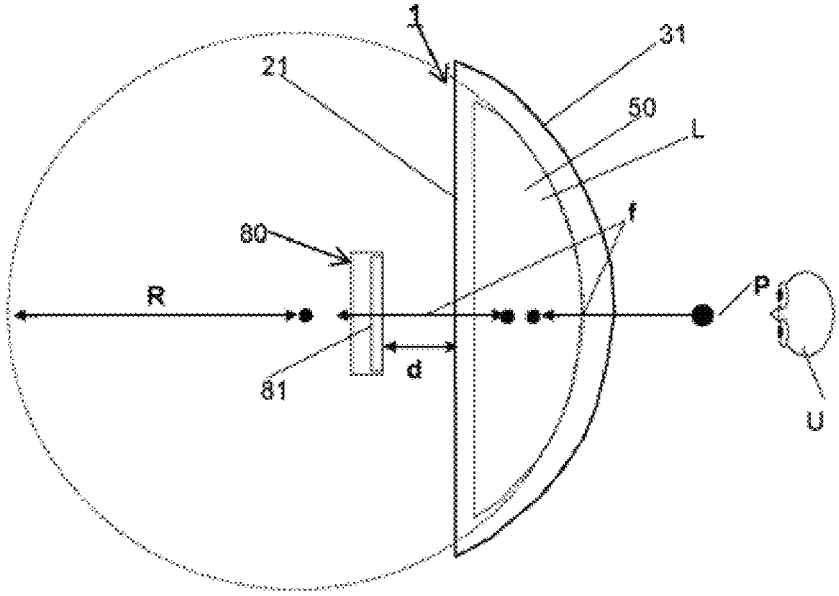
$$f \fallingdotseq \frac{R}{n-1} \quad \cdots \text{Formula 1}$$
$$M \fallingdotseq \frac{250}{f} \quad \cdots \text{Formula 2} \qquad M \fallingdotseq \frac{250}{f} + 1 \quad \cdots \text{Formula 3}$$
[FIG. 4]
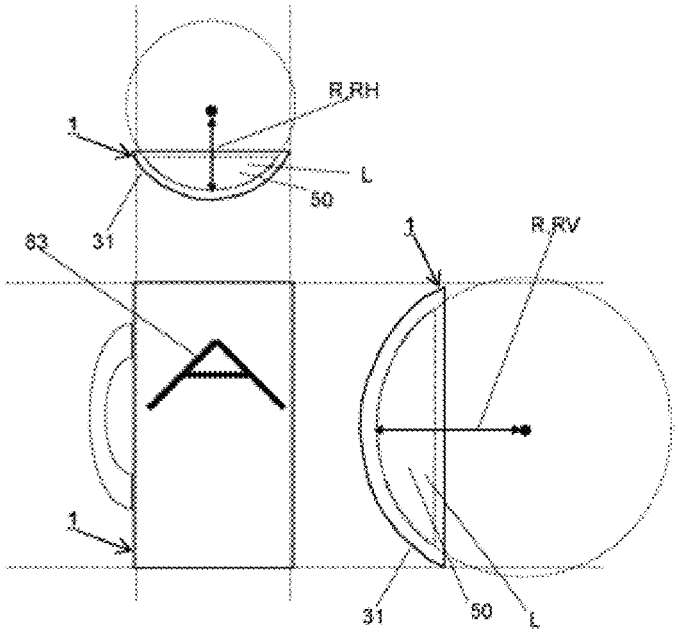
RH<RV

[FIG. 5]
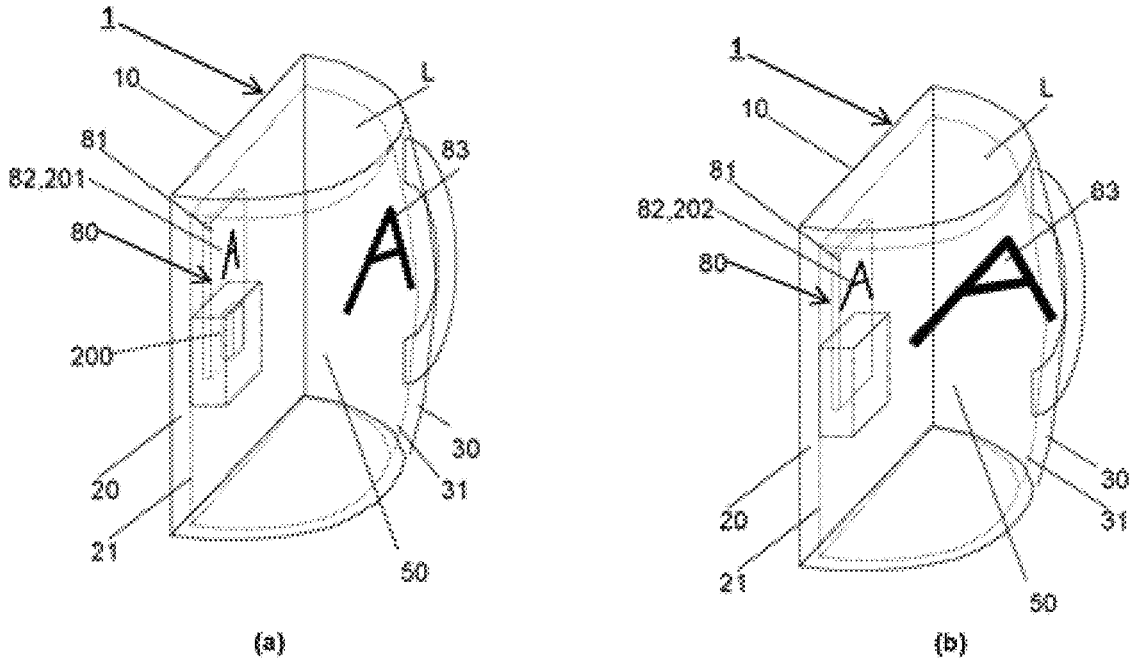
[FIG. 6]
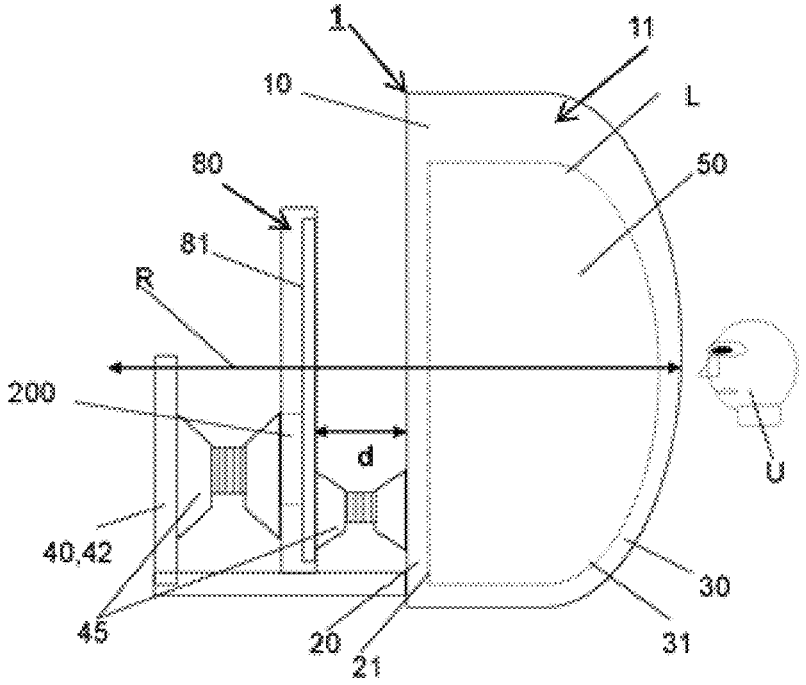

[FIG. 7]
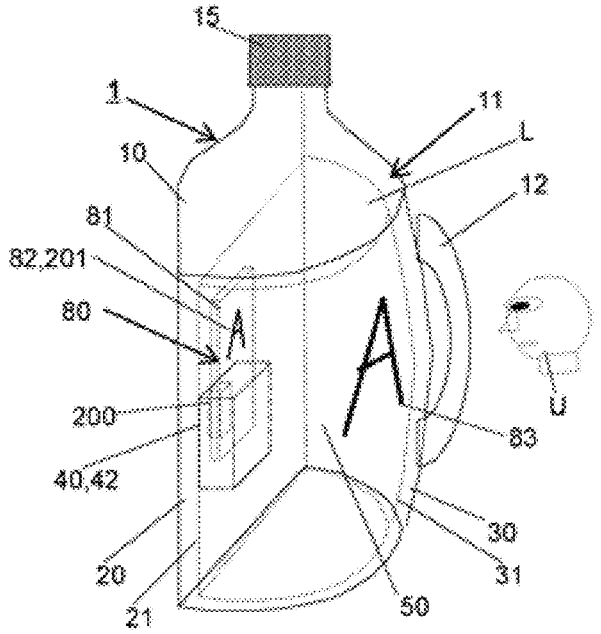
[FIG. 8]
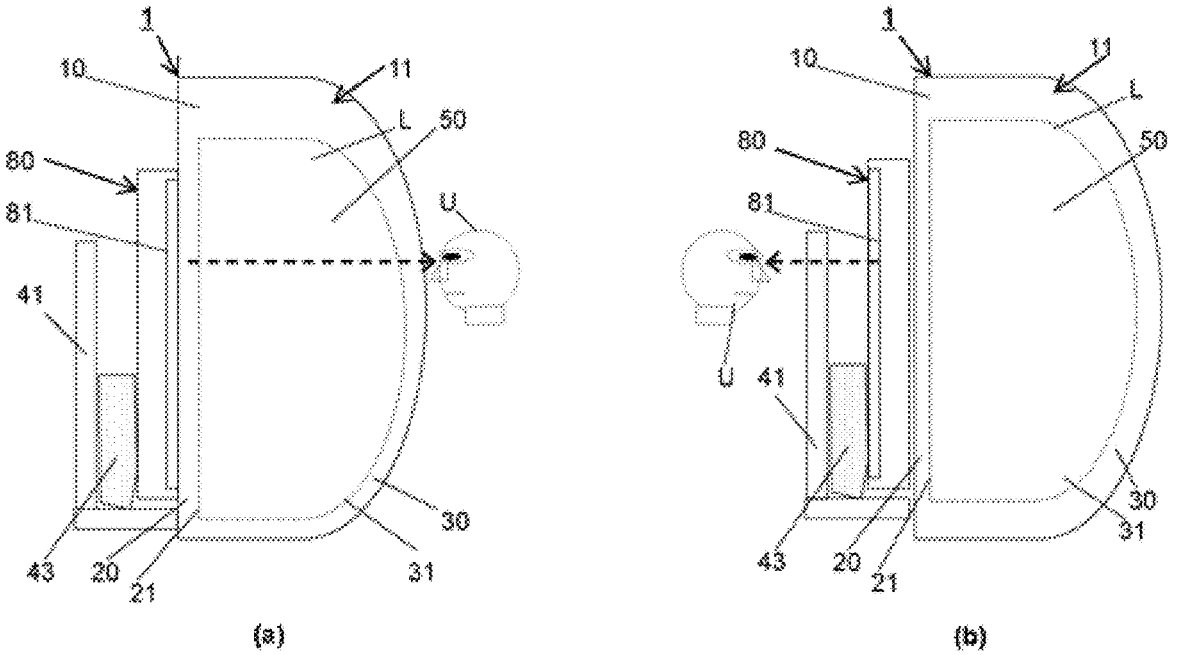

[FIG. 9]
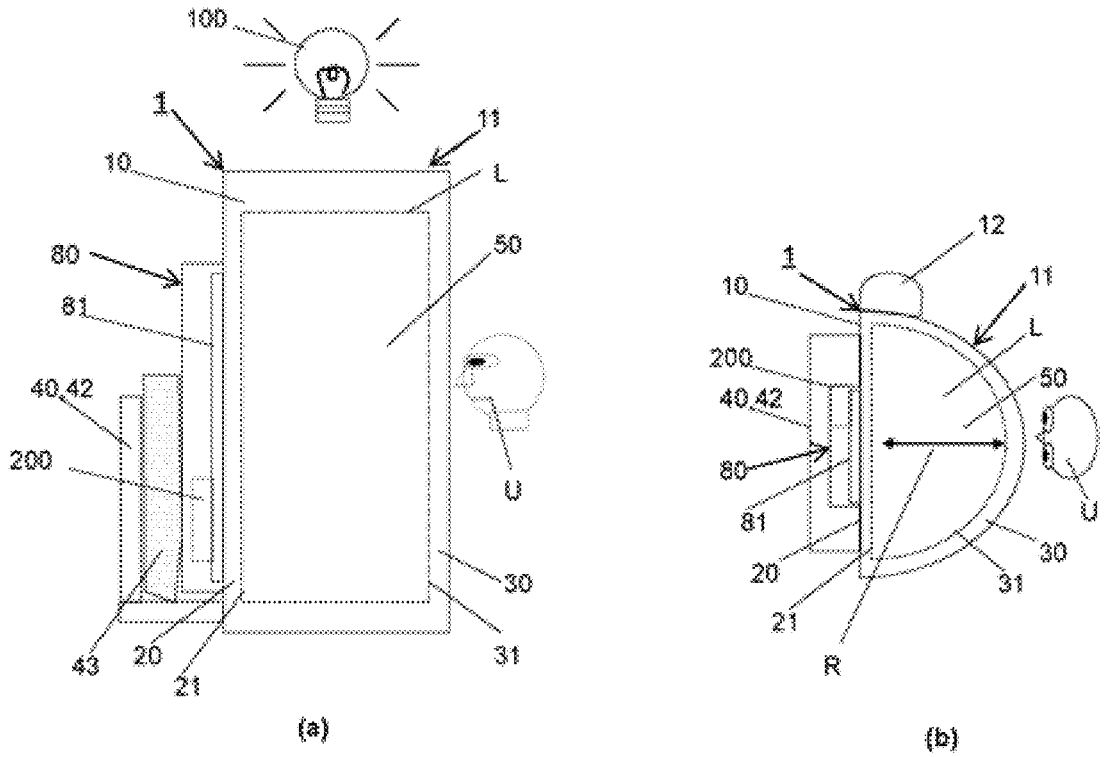
[FIG. 10]
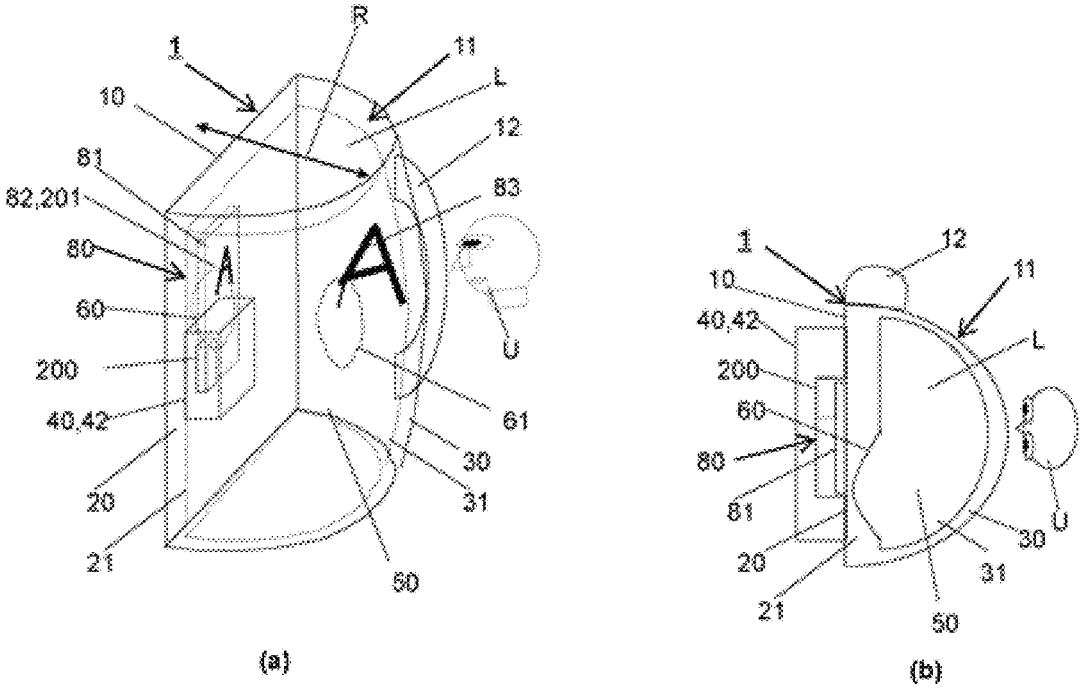

[FIG. 11]
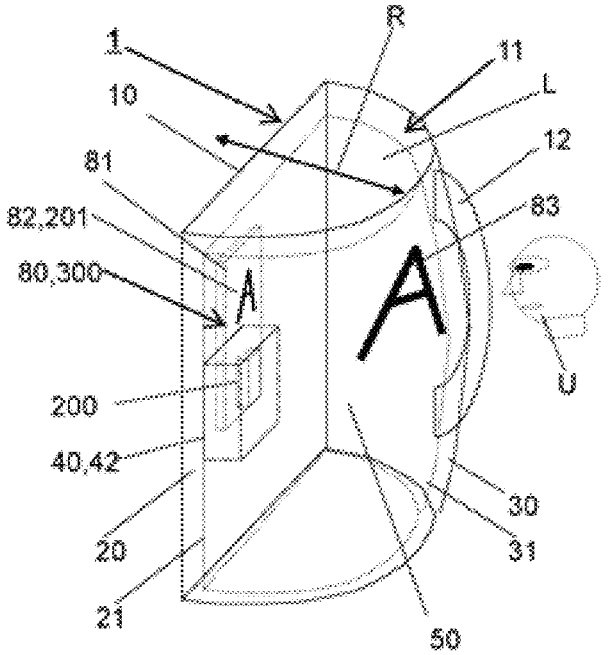
[FIG. 12]
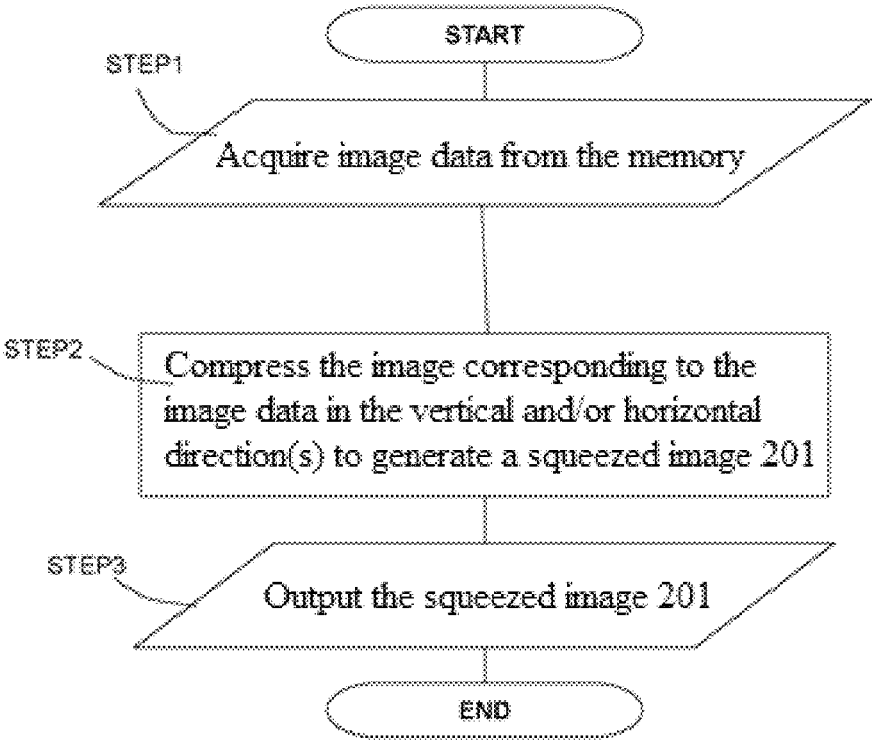

[FIG. 13]
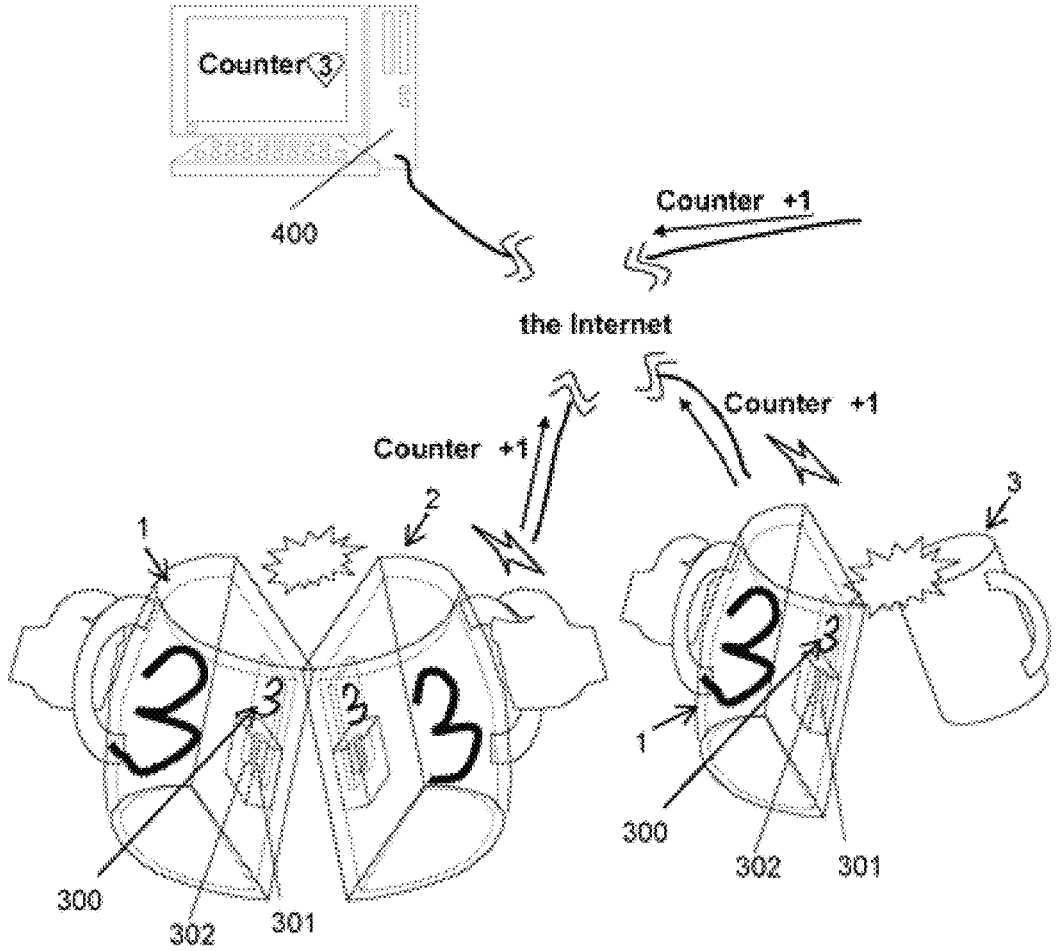

DRINKING DRAMATIZATION GLASS, STORAGE MEDIUM, AND REMOTE TOAST COUNTER SYSTEM

CROSS-REFERENCE TO RELATED APPLICATIONS

This application is the U.S. National Phase under 35 U.S.C. § 371 of International Application PCT/JP2020/035887, filed Sep. 24, 2020, which claims priority to Japanese Patent Application No. JP2019-191516, filed Oct. 1, 2019. The International Application was published under PCT Article 21(2) in a language other than English.

TECHNICAL FIELD

The present invention relates to a drinking dramatization glass featuring a function to change the aspect ratio of images, as well as a function to enlarge displayed images, using a liquid inside the glass.

BACKGROUND ART

Glasses have been developed that offer various functions in addition to containing drinks.

For example, Patent Literatures 1 and 2 disclose an art of placing a display device on the surface of a glass and allowing the image shown on the display device to be switched manually or according to the output of a motion sensor that detects the state of the glass.

Patent Literatures 3 to 5 disclose drinking dramatization glasses invented by the inventor of the invention under the present application for patent. These drinking dramatization glasses comprise: a glass body; a storage part extending from the bottom part, toward the interior side, of the glass body for storing a mobile communication device; and a waveguide part extending from the side face, toward the interior side, of the glass body for letting the radio waves from the mobile communication device pass through. These drinking dramatization glasses can communicate wirelessly by outputting the radio waves from the mobile communication device to the exterior via the waveguide part, even when a drink is filled in the glass body.

Patent Literature 6 discloses a drinking dramatization glass invented by the inventor of the invention under the present application for patent. This drinking dramatization glass comprises an image display device fixed on the side face of the glass, as well as a reflective mirror placed inside the glass body, so that the glass can achieve a dramatization effect of projecting a pseudo-image inside the glass based on the image on the image display device.

BACKGROUND ART LITERATURE

Patent Literature

Patent Literature 1: Japanese Patent Laid-open No. 2005-99159
Patent Literature 2: U.S. Patent laid-open No. 2008/0100469
Patent Literature 3: Japanese Patent No. 6337256
Patent Literature 4: Japanese Patent No. 6406742
Patent Literature 5: Japanese Patent No. 6432960
Patent Literature 6: Japanese Patent No. 6488049

SUMMARY OF THE INVENTION

Problems to be Solved by the Invention

However, Patent Literatures 1 to 4 above present a problem in that, when dealing with images containing small characters, etc., visually recognizing those characters will be difficult, which is unfriendly to users suffering from presbyopia or astigmatism unless the images are enlarged.

Patent Literatures 5 and 6 above, each having a constitution in which a lens for enlarging images is provided separately on the side face of the glass, present a problem in that, even when a lens of a size that roughly covers the image display device of 5 inches or so, is used, the weight of the glass body will increase by a minimum of around several hundred grams, making it difficult for women and children with weak physical strength to use the glass.

Furthermore, all of Patent Literatures 1 to 6 above present a problem in that the aspect ratios of images cannot be changed according to the size or shape of the glass.

In light of the aforementioned problems, an object of the present invention is to provide a drinking dramatization glass that is lightweight and capable of showing images on the side face of the glass by changing their aspect ratios according to the size of the glass, a remote toast counter system using such glass, and a storage medium in which a program used with such glass is recorded.

Means for Solving the Problems

The drinking dramatization glass proposed by the present invention comprises: a glass body being a bottomed cylinder body with a top opening, having, on its side face, a flat part made of a transparent material and a curved part made of a transparent material; a fixing mechanism for fixing, on the flat part, an image display device with its image display surface oriented in the direction of the flat part; and an image aspect ratio control part for outputting an image to the image display device by changing its aspect ratio; wherein such drinking dramatization glass is characterized in that: the curved part is placed at a position opposite the flat part; the curved part is curved in a convex shape toward the outer side of the glass body; the curved part has, over its surface on the side contacted by a drink filled in the glass body, a curved surface that curves along the curved part; the flat part has a flat surface over its surface on the side contacted by the drink; and the curved surface has a radius of curvature that, when an image shown on the image display surface is viewed from the outer side of the glass body through the drink and the curved part, allows a virtual image to be seen as an enlarged version of the image.

Additionally, it is characterized in that the radius of curvature of the curved surface in the vertical direction is different form the radius of curvature of the curved surface in the horizontal direction.

Additionally, it is characterized in that the curved surface curves only in the horizontal direction and does not curve in the vertical direction.

Additionally, it is characterized in that the fixing mechanism is made of a transparent material.

It is characterized in that the fixing mechanism has an adjuster mechanism by which the distance between the image display surface and the flat part can be adjusted.

Additionally, it is characterized in that a sheet made of an air-impermeable material having transparency and stretchability is provided between the flat part and the image display surface and that the fixing mechanism causes the image display surface and the flat part to adhere together via the sheet.

Additionally, it is characterized in that the fixing mechanism is a pocket structure made of a material having transparency.

Additionally, it is characterized in that it has a spacer to be inserted into the pocket structure and that the spacer is made of a material having stretchability and transparency.

Additionally, it is characterized in that the pocket structure is made of a pliable material.

Additionally, it is characterized in that it has a lid for closing off the top opening.

Additionally, it is characterized in that a part of the flat part constitutes a plano-concave lens.

Additionally, it is characterized in that the image display device is a part of a mobile communication device and that the image aspect ratio control part represents software built into the mobile communication device.

The remote toast counter system proposed by the present invention comprises: the aforementioned drinking dramatization glass; an external server computer; and a user operation detection part; which is characterized in that the user operation detection part detects, based on data output from an acceleration sensor in the mobile communication device, that the user has moved or tilted the glass body or clinked it against other object (hereinafter referred to as "user operation") and then transmits an output signal to the external server computer, while the external server computer receives the output signal, counts the number of times such signal has been received, and records the result as a cumulative number of toasting operations so that the user can view the cumulative number of toasting operations.

The storage medium proposed by the present invention is a storage medium in which a computer program used with the aforementioned drinking dramatization glass is saved, which is characterized in that the computer program generates a squeezed image which is an image output to the image display device that has been compressed in the vertical direction and/or horizontal direction.

Effects of the Invention

By constituting the glass body in such a way that its side face has the flat part and the curved part, each made of a transparent material, the drink (liquid) inside the glass body can have a shape identical to that of a plano-convex lens whose one side is flat and other side opposite thereto has a convex shape, and consequently the image on the image display surface of the image display device which is fixed on the flat part can be enlarged for viewing by the user. This is because the drink inside the glass body that has changed its shape to one conforming to the flat part and the curved part, turns into an optical refraction medium (water has a refractive index of approx. 1.333) and thus functions as a plano-convex lens.

Because the lens and the drink in the glass body are one and the same, the weight of the glass body can be reduced.

The magnification factor and focal distance of the image, as viewed from the user, can be adjusted by adjusting the value of radius of curvature of the surface of the curved part on the side contacted by the drink (hereinafter simply referred to as "curved surface").

When the curved surface is set to have different values for its radius of curvature in the vertical direction and radius of curvature in the horizontal direction, the image that has transmitted through the drink in the glass can be enlarged, with the aspect ratio of the image also changed at the same time, which means that the aspect ratio of the image on the side face of the glass can be changed according to the shape and size of the glass.

Because the image aspect ratio control part is provided, the image can be enlarged without changing its aspect ratio even when the glass body is designed to have different values for its radius of curvature in the vertical direction and radius of curvature in the horizontal direction. Also, the aspect ratio of the image can be controlled on the software side, depending on the situation.

When the image aspect ratio control part is installed beforehand as software for the mobile communication device, the image from the mobile communication device can be enlarged in a manner that allows for at-will control of its aspect ratio.

When the value of radius of curvature of the curved surface in the vertical direction is infinitely large, or specifically when the glass body is shaped like a column that does not curve in the vertical direction, ceiling lights or other light sources can be prevented from reflecting on the curved part or curved surface on the side face of the glass body, to permit comfortable image viewing.

When the distance between the flat part and the image display surface is made variable, the user can adjust the magnification factor and focal point of the image seen through the drink inside the glass.

Only a desired area of the image can be enlarged by sliding the image display device horizontally with respect to the flat part.

A dramatization effect of coloring the image on the side face of the glass according to the color of the drink, can be achieved.

Because the optical refractive index varies depending on the type of drink, a dramatization effect of changing the image magnification factor for each drink can be achieved.

When the glass is tilted, the image in the glass also tilts synchronously according to the tilting of the glass, which makes the glass useful in dramatizing a toast, etc.

When the image display device is a mobile communication device equipped with an acceleration sensor, toasting actions involving clinking or tilting together of glass bodies can be detected and transmitted to the external server so that the number of toasting operations can be counted and published by such remote server. Also, the number of toasting operations counted in real time by the remote server can be projected onto the glass body using enlarged text.

Because the image display device can be fixed on the glass body in such a way that its flat part is fully contacting the image display surface of the image display device, air can be eliminated from between the image display surface and the flat part and consequently fogging (condensation) of the image display surface can be prevented.

The image display surface can be firmly fixed on the flat part simply by applying pressure (or tension), using a spring mechanism, rubber belt mechanism, etc., in the direction of pressing the image display surface against the flat part, and because the resulting stress the image display surface receives from the flat part takes a form of area stress and is dispersed, the image display surface is prevented from being damaged by the flat part.

Not only plano-convex lenses, but also any convex lenses normally work in such a way that, (just like magnifying glasses) the greater the distance between the object to be enlarged and the lens, the larger and more enlarged the object appears. As a result, the image magnification factor can be increased or decreased by controlling the thickness of the glass in the flat part.

Disposing the sheet made of an air-impermeable material having transparency and flexibility between the flat part and the image display surface prevents fogging (condensation) of the image display surface and further allows the image magnification factor to be increased or decreased by increasing or decreasing the thickness of the sheet.

When a pocket structure is used as the fixing mechanism for fixing the image display device on the glass body, the image display device will not come off of the glass even when the glass is tilted, and can also be removed and installed with ease. In addition, use of a material having stretchability for the spacer to be inserted into the pocket structure not only allows image display devices and mobile phones of different thickness sizes to be fixed on the side face of the glass, but also makes it possible to keep the image display surface constantly pressed against the flat part using the stress attributable to the stretchability of the spacer, and this increases the fixing strength of the image display device. It should be noted that both the pocket structure and spacer may use a transparent material so that the user can accurately view the fixed position of the image display device, in which case fine-tuning of the fixed position, and sliding, of the image display device will become easy.

When the pocket structure or other fixing mechanism for fixing the image display device on the glass body is made entirely of a transparent material, viewing of images is always possible regardless of whether the image display device is fixed in a manner oriented in the direction of the inner side of the glass or outer side of the glass. As a result, the drinking dramatization glass proposed by the present invention can be reversibly switched between a normal usage mode in which images are transmitted through the drink in the glass body and enlarged for viewing, and a usage mode in which images are viewed without being transmitted through the drink.

Constituting a part of the flat part or flat surface with a concave lens (minus lens) allows for a dramatization effect of increasing or decreasing the magnification factor for only a partial area of an image.

BRIEF DESCRIPTION OF THE DRAWINGS

FIG. 1 A perspective view (a), and a top cross-sectional view (b), showing the drinking dramatization glass in the first embodiment.

FIG. 2 Cross-sectional views (a), (b) representing examples in which a pocket structure is adopted as the fixing mechanism.

FIG. 3 A drawing showing an example of calculating the focal distance and magnification factor of a plano-convex lens.

FIG. 4 A drawing showing the relationship between the radii of curvature of the curved surface in the vertical direction and horizontal direction and the resulting aspect ratio of the image being enlarged.

FIG. 5 A drinking dramatization glass (a) with an image aspect ratio control part, and a drinking dramatization glass (b) without image aspect ratio control part.

FIG. 6 A cross-sectional view representing an example in which the distance between the flat part and the image display surface is made variable.

FIG. 7 A perspective view showing a bottle-shaped drinking dramatization glass.

FIG. 8 Cross-sectional views (a), (b) showing the drinking dramatization glass in the second embodiment.

FIG. 9 A cross-sectional view (a), and a top cross-sectional view (b), showing the drinking dramatization glass in the third embodiment.

FIG. 10 A perspective view (a), and a top cross-sectional view (b), showing the drinking dramatization glass in the fourth embodiment.

FIG. 11 A perspective view showing the drinking dramatization glass in the fifth embodiment.

FIG. 12 A flowchart of a horizontal/vertical image compression program.

FIG. 13 A drawing showing the constitution of a remote toast counter system.

MODE FOR CARRYING OUT THE INVENTION

First Embodiment of Drinking Dramatization Glass

The first embodiment of the drinking dramatization glass proposed by the present invention is presented below using the drawings.

As shown in FIG. 1, the drinking dramatization glass 1 roughly comprises a glass body 10, a flat part 20, a flat surface 21, a curved part 30, a curved surface 31, a fixing mechanism 40, and an image aspect ratio control part 200.

The glass body 10 is a bottomed cylinder with a top opening 11, allowing a soft drink, alcoholic drink, or other drink L to be filled inside. The material for the glass body 10 may be glass, resin, ceramic, porcelain, etc., just like for general glasses.

The glass body 10 has, on its side face, a flat part 20 which is flat and made of a transparent material, and the flat part 20 has a flat surface 21 over its surface on the side contacted by the drink L filled inside the glass body 10.

The flat part 20 is provided to fix an image display device 80 on the glass body 10 in a stable manner, and to let the light constituting an image 82 on the image display device 80 pass through in the direction of the opposing curved part 30. Because it is flat, the flat part 20 can closely adhere to an image display surface 81 of the image display device 80 to eliminate air from between the image display surface 81 and the flat part 20, thereby preventing condensation on the flat part 20 and the image display surface 81.

The glass body 10 has, on its side face at a position opposite the flat part 20, a curved part 30 which curves in a convex shape toward the outer side of the glass body 10 and is made of a transparent material, and the curved part 30 has, over its surface on the side contacted by the drink L filled inside the glass body 10, a curved surface 31 that curves along the curved part 30. The curved part 30 is provided so that the user U on the exterior of the glass body 10 can view a virtual image 83 representing an enlarged image based on magnification of the image 82.

The fixing mechanism 40 is a member for fixing the image display device 80 on the flat part 20. The fixing mechanism 40 fixes the image display device 80 on the flat part 20 with the image display surface 81 oriented in the direction of the flat part 20. In this embodiment, a pocket structure 42 like the one shown in FIG. 1 or FIG. 2 is provided as the fixing mechanism 40; however, the drinking dramatization glass proposed by the present invention is not limited to the foregoing and a rubber belt mechanism, clamp mechanism, etc., may be used as the fixing mechanism 40.

The image aspect ratio control part 200 is an image compression mechanism for generating and outputting a squeezed image 201 representing the image 82 on the image display device 80 that has been compressed either in the vertical direction or horizontal direction, so that the image 82 that was transmitted through the flat part 20 and curved part 30 and thus enlarged (virtual image 83, that is) will have the same aspect ratio. It should be noted that the image aspect ratio control part 200 may be provided in the form of a dedicated IC, enclosure, or external computer, or cloud server, or it may be a program or application software built or installed in the enclosure of the image display device 80. Details of the image aspect ratio control part 200 will be described later.

The shape of the glass body 10 may be a so-called mug type with a handle 12 as shown in FIG. 1, or a bottle type having a lid 15 for closing off the top opening 11 as shown in FIG. 7.

Because of the flat part 20 (or, strictly, the flat surface 21) and the curved part 30 (or, strictly, the curved surface 31), the drink L filled inside the glass has a shape identical to that of a plano-convex lens whose one side is flat and other side opposite thereto has a convex shape, and therefore the virtual image 83, being an enlarged version of the image 82 on the image display device 80 fixed on the flat part 20, can be displayed to the user U.

This is because the refractive index of water is approx. 1.333 and higher than the refractive index of air, causing the drink L whose shape has changed to that of a plano-convex lens conforming to the flat surface 21 and the curved surface 31 to turn into an optical refraction medium and thus function as a plano-convex lens 50. It should be noted that, since the curved surface 31 is curved, its radius of curvature R always takes a finite value.

Because the optical refractive index varies depending on the type of drink L (for example, the refractive index of pure water is approx. 1.33, while the refractive index of sugar water of 20% in concentration is approx. 1.37), the drinking dramatization glass 1 proposed by the present invention can achieve a dramatization effect of changing the image magnification factor based on each type of drink L.

FIG. 3 is a drawing showing an example of calculating the focal distance and magnification factor of a plano-convex lens.

As shown by Formula 1, the focal distance f of a plano-convex lens 50 is known to approximate the value obtained by dividing R by n−1, where n represents the refractive index of the optical refraction medium constituting the lens and R represents the radius of curvature of the convex part of the plano-convex lens 50 (for details, refer to technical books on optical science or those on lens formulas). In the meantime, when a virtual image (enlarged version of the image) is produced at a position 250 [mm] away from the eyes (this distance is referred to as "distance of distinct vision"), the magnification factor M indicating how many times larger the virtually image becomes relative to the actual object is known to approximate the value obtained by dividing 250 by f as in Formula 2, or the value obtained by dividing 250 by f and then adding 1 to the resulting value as in Formula 3, where f represents the focal distance of the lens (for details, refer to technical books on lenses and optical science). This goes to show that, based on Formula 1 and Formula 2 or Formula 1 and Formula 3, the magnification factor of the image 82 can be increased by decreasing the radius of curvature R of the curved surface 31.

FIG. 4 is a drawing showing the relationship between the radii of curvature of the curved surface in the vertical direction and horizontal direction, and the resulting aspect ratio of the image being enlarged.

As shown in FIG. 4, the radius of curvature R of the curved surface 31 may mean a radius of curvature in horizontal direction RH or radius of curvature in vertical direction RV, and therefore by setting the radius of curvature RH and the radius of curvature RV to different values, the aspect ratio of the virtual image 83, which is an enlarged image, can be changed from that of the actual image 82. For example, as shown in FIG. 4, setting the radius of curvature in horizontal direction RH to a value smaller than the radius of curvature in vertical direction RV causes the virtual image 83 to appear stretched in the horizontal direction. By contrast, setting the radius of curvature RH to a value greater than the radius of curvature RV causes the virtual image 83 to appear stretched in the vertical direction. This means that, by adjusting the radius of curvature RH and the radius of curvature RV to different values, the aspect ratio and magnification factor of the virtual image 83 can be adjusted according to the size, aspect ratio, shape, and design of the glass body. Also, by setting the radius of curvature RH to a value equal to the radius of curvature RV, or, put differently, by making the curved surface 31 spherical, the image 82 and the virtual image 83 can have an equal aspect ratio.

As is evident from Formula 1 and Formula 2 or Formula 3 in FIG. 3, the necessary condition for the user U to be able to view the virtual image 83 representing the image 82 that has been enlarged, is that the radius of curvature R takes a finite value, and no matter how great the value of the radius of curvature R, the virtual image 83 will always be enlarged compared to the image 82, even if by a little, so long as the radius of curvature R takes a finite value. However, one's ability to recognize how much the image 82 has been enlarged is affected by his/her visual acuity, ocular diameter and size, and many other parameters, and thus varies among the individuals (for details, refer to technical books on lenses and optical science). Accordingly, caution must be exercised that, if the glass body 10 is produced using an excessively large value of radius of curvature (such as one in the order of several meters), the user may not be able to recognize the enlarged effect of the image 82 because the magnification factor is too small.

When producing the glass proposed by the present invention, it would be good to select values in a range of the order of several centimeters to the order of several tens of centimeters for the radius of curvature RH and the radius of curvature RV in consideration of practical radii and magnification factors for a glass.

It requires caution that, when designing a glass, setting the radius of curvature RH or the radius of curvature RV to an unnecessarily small value with the intention of increasing the magnification factor may lead to noticeable distortion, with the virtual image 83 distorting significantly at its outer edges.

Also, another possible method for raising the magnification factor of the image 82, besides decreasing the radius of curvature R, is to increase the distance between the glass body 10 and the image display surface 81 (this, based on the same principle behind a magnifying glass, is also supported by lens formulas). This method may be used in combination if the radius of curvature R cannot be decreased for glass design or other reasons.

As described above, the drinking dramatization glass 1 proposed by the present invention is such that, due to its nature of allowing the aspect ratio of the virtual image 83 representing an enlarged image of the image 82 to be changed or adjusted through adjustment, to different values, of the radius of curvature in horizontal direction RH, and the radius of curvature in vertical direction RV, of the curved surface 31, the virtual image 83 will appear in a manner stretched in the vertical direction or horizontal direction when the drinking dramatization glass 1 is shaped or designed with its radius of curvature in horizontal direction RH and radius of curvature in vertical direction RV set to different values. If the aspect ratio of the virtual image 83 is to be matched with that of the image 82, it can be accomplished by generating a squeezed image 201 that has been compressed beforehand in the vertical direction or horizontal direction using the image aspect ratio control part 200, and then outputting it as an image 82 on the image display device 80.

FIG. 5 provides drawings showing the conditions of the aspect ratios of virtual images 83 on drinking dramatization glasses 1 with and without the image aspect ratio control part 200.

It should be noted that, for the sake of explanation, the following explanation assumes that the curved surfaces 31 of the drinking dramatization glasses 1 in FIG. 5 (*a*) and FIG. 5 (*b*) have a shape whose radius of curvature in horizontal direction RH is smaller than radius of curvature in vertical direction RV (in other words, the image 82 is enlarged more in the horizontal direction than in the vertical direction).

When the image aspect ratio control part 200 is not provided, as in FIG. 5 (*b*), the image 82 shown on the image display device is a non-squeezed image 202 that has been compressed in neither the vertical direction nor the horizontal direction, and consequently the virtual image 83 representing an enlarged image of the image 82 appears more enlarged in the horizontal direction than in the vertical direction (in other words, it appears stretched in the horizontal direction, like the letter A shown on the curved surface 31 in FIG. 5 (*b*)).

Conversely, when the image aspect ratio control part 200 is provided, as in FIG. 5 (*a*), the image 82 shown on the image display device is a squeezed image 201 that has been compressed beforehand in the horizontal direction by considering, and also to the extent of cancelling out, the difference between the radius of curvature in horizontal direction RH, and the radius of curvature in vertical direction RV, of the curved surface 31, and consequently the image 82 and the virtual image 83 are seen by the user in the same aspect ratio (that is, the letter A in FIG. 5 is not enlarged in the horizontal direction like the letter A shown on the curved surface 31 in FIG. 5 (*b*)).

This means that, when the image aspect ratio control part 200 is used, the user can view an enlarged image (virtual image 83) whose aspect ratio is unchanged from that of the image 82, even when the drinking dramatization glass 1 (or, more strictly, the curved surface 31) has a shape whose radius of curvature in horizontal direction RH and radius of curvature in vertical direction RV are different.

Also, the squeezed image 201 generated by the image aspect ratio control part 200 need not be an image that has been compressed in the horizontal direction or vertical direction to the extent that the aspect ratio of the virtual image 83 matches the aspect ratio of the image 82 completely and, if the image 82 is a letter, for example, a squeezed image 201 may be used that has been compressed in the vertical direction or horizontal direction to the extent that the user can at least recognize the shape of the letter. The image aspect ratio control part 200 may be designed to generate or output a squeezed image 201 that has been compressed at any aspect ratio the user desires according to the shape or application of the glass or content of the image 82.

It should be noted that, regarding the method for generating a squeezed image 201 by compressing an image in the vertical direction or horizontal direction, any known vertical/horizontal image compression algorithm built into image editing software may be used. For example, a drinking dramatization glass 1 having radii of curvature that achieve an image magnification factor of five times in the horizontal direction allows five images to be simultaneously projected side by side when the compression ratio of a squeezed image 201 is set to five times in the horizontal direction.

When a pocket structure 42 is used as the fixing mechanism 40, as shown in FIG. 2 and FIG. 6, the image display device 80 will not come off of the glass body 10 even when the glass body 10 is tilted to make a toast or to drink out of it, and the image display device 80 can be removed from/installed on the glass by sliding it horizontally relative to the flat part 20.

When a material having stretchability is used for a spacer 43 to be inserted into the pocket structure 42, as shown in FIG. 2 (*a*) and FIG. 2 (*b*), not only image display devices 80, mobile phones, etc., of various thickness sizes can be fixed on the side face of the glass, but it also becomes possible to keep the image display surface 81 constantly pressed against the flat part 20 using the stress attributable to the stretchability of the spacer 43, and consequently the fixing strength of the image display device 80 will increase. It should be noted that both the pocket structure 42 and spacer 43 may be constituted by a transparent material to allow the user U to correctly recognize the fixed position of the image display device 80 regardless of the direction from which the glass body is viewed, in which case fine-tuning of the fixed position, and sliding, of the image display device 80 will become easy. It should be noted that, for the material for the pocket structure 42, not only glass, acrylic, or other solid material, but also a flexible, transparent material such as vinyl chloride may be used, as this can reduce the size and weight of the glass body 10.

Not only plano-convex lenses, but also any convex lenses normally work in such a way that, (just like magnifying glasses) the greater the distance between the object to be enlarged and the lens, the larger and more enlarged the object appears. This means that, with the glass proposed by the present invention, the magnification factor of the image 82 can be increased or decreased by controlling the thickness of the glass in the flat part 20 and, as shown in FIG. 2 (*b*), a sheet 44 made of an air-impermeable material having transparency and flexibility may also be disposed between the flat part 20 and the image display surface 81 to increase or decrease the image magnification factor by increasing or decreasing the thickness of the sheet 44. Benefits of this method include protection of the image display surface 81 from the flat part 20 owing to the sheet 44 and also prevention of condensation on the image display surface 81 (because air does not enter between the image display surface 81 and the flat surface).

As shown in FIG. 6, an adjuster mechanism 45 that can change the distance d between the image display surface 81 and the flat part 20 may be provided to allow the user U on his/her own to adjust the image magnification factor. It should be noted that, for the adjuster mechanism 45, anything that adjusts the distance using a known thread mechanism, etc., may be used.

Second Embodiment of Drinking Dramatization Glass

The second embodiment of the drinking dramatization glass proposed by the present invention is presented below using the drawings, where locations that are constitutionally identical to the corresponding locations in the drinking dramatization glass 1 in the aforementioned first embodiment are denoted using the same symbols, and not explained.

The drinking dramatization glass in this embodiment is such that, by using, as the fixing mechanism 40, a fixing mechanism 41 made of a transparent material (for example, the pocket structure 42 made of a transparent glass, etc.), as shown in FIG. 8, image viewing becomes possible regardless of whether the image display device 80 (or, more strictly, the image display surface 81) is oriented toward the inner side of the glass body 10 as in FIG. 8 (*a*) or toward the outer side of the glass body 10 as in FIG. 8 (*b*). As a result, the drinking dramatization glass in this embodiment can be reversibly switched between a normal usage mode in which the image 82 is transmitted through the drink L in the glass body 10 and enlarged for viewing, and a usage mode in which it is viewed without being transmitted through the drink L.

Third Embodiment of Drinking Dramatization Glass

The third embodiment of the drinking dramatization glass proposed by the present invention is presented below using the drawings, where locations that are constitutionally identical to the corresponding locations in the drinking dramatization glass 1 in the aforementioned first embodiment are denoted using the same symbols, and not explained.

The drinking dramatization glass in this embodiment is such that, as shown in FIG. 9, the glass body has a columnar shape that does not curve in the vertical direction, or specifically the curved surface 31 has an infinitely large value for its radius of curvature in vertical direction RV. This prevents ceiling lights 100 or other light sources from reflecting on the curved part 30 (or, strictly, the drink contacting the curved surface 31) on the side face of the glass body 10 to permit comfortable image viewing.

Fourth Embodiment of Drinking Dramatization Glass

The fourth embodiment of the drinking dramatization glass proposed by the present invention is presented below using the drawings, where locations that are constitutionally identical to the corresponding locations in the drinking dramatization glass 1 in the aforementioned first embodiment are denoted using the same symbols, and not explained.

The drinking dramatization glass in this embodiment is such that, as shown in FIG. 10 (*b*), the member constituting the flat part 20 (such as a transparent glass, transparent acrylic resin, etc.) does not have uniform thickness and at least some area of the flat part 20 is a plano-concave lens 60 (minus lens) or shaped as a plano-concave lens (that is, a part of the flat surface 21 has a shape that concaves in the outward direction of the glass). This way, an area for decreasing the magnification factor of the image 82 only partially (described as "enlargement mitigation area 61" in FIG. 10 (*a*)) can be provided on the curved part 30.

By using the plano-concave lens 60, a drinking dramatization glass 1 whose magnification factor of the virtual image 83 is controlled only partially can be obtained.

Fifth Embodiment of Drinking Dramatization Glass

The fifth embodiment of the drinking dramatization glass proposed by the present invention is presented below using drawings, where locations that are constitutionally identical to the corresponding locations in the drinking dramatization glass 1 in the aforementioned first embodiment are denoted using the same symbols, and not explained.

The drinking dramatization glass in this embodiment is such that, as shown in FIG. 11, its image aspect ratio control part 200 may be present in the form of a computer program or software (application software) built or installed inside the image display device 80 or a mobile communication device 300 in which the image display device 80 is provided. It should be noted that the image display device 80 which is fixed on the drinking dramatization glass 1 proposed by the present invention may be an image display device of a mobile communication device 300, as shown in FIG. 11.

FIG. 12 shows a flowchart of a computer program for generating or outputting a squeezed image 201 by compressing an image in the vertical direction or horizontal direction of the image.

In STEP 1, an original image 82 that has been compressed in neither the vertical direction nor the horizontal direction is loaded from the memory of the computer in the image display device 80 or mobile communication device 300. In STEP 2, the image 82 is compressed in the vertical direction or horizontal direction of the image (for the compression algorithm, photo retouching software or any known algorithm built into an LD or DVD playback device, etc., may be used) to create a squeezed image 201. Then, in STEP 3, this squeezed image 201 is output to the image display device 80 or mobile communication device 300.

It should be noted that the computer program represented by the flowchart shown in FIG. 12 should be saved in a flash memory, DRAM, magnetic storage medium, optical storage medium, or other known storage medium. It may also be installed (saved) in the internal memory of the mobile communication device 300 in the form of application software.

Embodiment of Remote Toast Counter System

An embodiment of the remote toast counter system proposed by the present invention is explained below. Locations that are constitutionally identical to the corresponding locations in the drinking dramatization glass in each of the aforementioned embodiments are denoted using the same symbols, and not explained.

A majority of models of mobile phones, smartphones, and other mobile communication terminals have a built-in acceleration sensor. An acceleration sensor allows for acquisition of the amount of movement or tilting of the object into which the acceleration sensor is built, and whether or not the object has hit another object, based on the acceleration of the object. Accordingly, the remote toast counter system in this embodiment comprises a drinking dramatization glass 1 conforming to the present invention, and a user operation detection part 302 that monitors the value of sensor-acquired data from an acceleration sensor 301 in the mobile communication device 300, as shown in FIG. 13.

Based on the signal from the acceleration sensor 301 in the mobile communication device 300, the user operation detection part 302 detects a user operation performed on the glass body 10 (such as an operation of clinking the glass body 10 against other drinking glass, tilting the glass body, etc.) and transmits a signal to a remote server computer 400, etc. As shown in FIG. 13, the remote server computer 400 counts the number of times such signal has been received and records the result as a cumulative number of toasting operations for viewing or publication, to obtain a remote toast counter system. It should be noted that, as shown in FIG. 13, the acceleration sensor 301 or user operation detection part 302 to be used may be one in which the parameters have been set to detect not only clinking of the drinking dramatization glass 1 against other standard drinking glass 3, but also tilting of the glass body 10, as a toasting action. Also, the user operation detection part 302 need not be built into the enclosure of the mobile communication device 300 and may be installed as software in an external cloud computer instead.

INDUSTRIAL FIELD OF APPLICATION

The present invention relates to a drinking dramatization glass that uses, as an optical refraction medium, a drink inside its glass body whose side face is constituted by a transparent flat surface and a transparent curved surface, and uses the resulting plano-convex lens to enlarge an image shown on an image display device on the side face of the glass. Because the lens, the drink in the glass, and the image display device are integrated in one body, a clear image can be transmitted through the drink in the glass to be enlarged, while the glass body can also be made lighter. By using a transparent fixing mechanism, the image display device can also be fixed in a reversible manner. Additionally, the image aspect ratio control part can project a squeezed image that has been compressed either vertically or horizontally so that any image can be enlarged in the same aspect ratio regardless of the value of the ratio of the radius of curvature in the vertical direction, and that in the horizontal direction, of the glass body. Based on the above, the present invention has industrial applicability.

DESCRIPTION OF THE SYMBOLS

L Drink (liquid)
d Distance (distance between the flat part and the image display surface)
R Radius of curvature
RV Radius of curvature (in vertical direction)
RH Radius of curvature (in horizontal direction)
P Focal point
n Refractive index
f Focal distance
M Magnification factor
U User
UH User's hand
1 Drinking dramatization glass
2 Drinking glass
10 Glass body
11 Top opening
12 Handle
15 Lid
20 Flat part
21 Flat surface
30 Curved part
31 Curved surface
40 Fixing mechanism
41 Fixing mechanism (transparent)
42 Pocket structure
43 Spacer
44 Sheet
45 Adjuster mechanism
50 Plano-convex lens
60 Plano-concave lens
61 Enlargement mitigation area
80 Image display device
81 Image display surface
82 Image
83 Virtual image (enlarged version of the image)
100 Ceiling light
200 Image aspect ratio control part
201 Squeezed image
202 Non-squeezed image (uncompressed image)
300 Mobile communication device
301 Acceleration sensor
302 User operation detection part
400 Server computer

What is claimed is:

1. A drinking dramatization glass comprising:
a glass body being a bottomed cylinder body with a top opening, having, on its side face, a flat part made of a transparent material and a curved part made of a transparent material;
a fixing mechanism for fixing, on the flat part, an image display device with its image display surface oriented in a direction of the flat part; and
an image aspect ratio control part for outputting an image to the image display device by changing its aspect ratio;
characterized in that:
the curved part is placed at a position opposite the flat part;
the curved part is curved in a convex shape toward an outer side of the glass body;
the curved part has, over its surface on a side contacted by a drink filled in the glass body, a curved surface that curves along the curved part;
the flat part has a flat surface over its surface on a side contacted by the drink; and
the curved surface has a radius of curvature that, when an image shown on the image display surface is viewed from the outer side of the glass body through the drink and the curved part, allows a virtual image to be seen as an enlarged version of the image.

2. The drinking dramatization glass according to claim 1, characterized in that a radius of curvature of the curved surface in a vertical direction is different from a radius of curvature of the curved surface in a horizontal direction.

3. The drinking dramatization glass according to claim 1, characterized in that the curved surface curves only in a horizontal direction and does not curve in a vertical direction.

4. The drinking dramatization glass according to claim 1, characterized in that the fixing mechanism is made of a transparent material.

5. The drinking dramatization glass according to claim 1, characterized in that the fixing mechanism has an adjuster mechanism by which a distance between the image display surface and the flat part can be adjusted.

6. The drinking dramatization glass according to claim 1, characterized in that:
a sheet made of an air-impermeable material having transparency and stretchability is provided between the flat part and the image display surface; and
the fixing mechanism causes the image display surface and the flat part to adhere together via the sheet.

7. The drinking dramatization glass according to claim 1, characterized in that the fixing mechanism is a pocket structure made of a material having transparency.

8. The drinking dramatization glass according to claim 7, characterized in that:
it has a spacer to be inserted into the pocket structure; and
the spacer is made of a material having stretchability and transparency.

9. The drinking dramatization glass according to claim 7, characterized in that the pocket structure is made of a pliable material.

10. The drinking dramatization glass according to claim 1, characterized in that it has a lid for closing off the top opening.

11. The drinking dramatization glass according to claim 1, characterized in that a part of the flat part constitutes a plano-concave lens.

12. The drinking dramatization glass according to claim 1, characterized in that:

the image display device is a part of a mobile communication device; and the image aspect ratio control part represents software built into the mobile communication device.

13. A remote toast counter system comprising:

the drinking dramatization glass according to claim 12;

an external server computer; and a user operation detection part;

characterized in that:

the user operation detection part detects, based on data output from an acceleration sensor in the mobile communication device, that the user has moved or tilted the glass body or clinked it against other object and then transmits an output signal to the external server computer; and the external server computer receives the output signal, counts a number of times such signal has been received and records a result as a cumulative number of toasting operations so that the user can view the cumulative number of toasting operations.

14. A storage medium in which a computer program used with the drinking dramatization glass in claim 1 is saved, characterized in that the computer program generates a squeezed image which is an image output to the image display device that has been compressed in the vertical direction and/or horizontal direction.

15. The drinking dramatization glass according to claim 2, characterized in that the curved surface curves only in a horizontal direction and does not curve in a vertical direction.

16. The drinking dramatization glass according to claim 2, characterized in that the fixing mechanism is made of a transparent material.

17. The drinking dramatization glass according to claim 2, characterized in that the fixing mechanism has an adjuster mechanism by which a distance between the image display surface and the flat part can be adjusted.

18. The drinking dramatization glass according to claim 2, characterized in that:

a sheet made of an air-impermeable material having transparency and stretchability is provided between the flat part and the image display surface; and the fixing mechanism causes the image display surface and the flat part to adhere together via the sheet.

19. The drinking dramatization glass according to claim 2, characterized in that the fixing mechanism is a pocket structure made of a material having transparency.

20. The drinking dramatization glass according to claim 2, characterized in that it has a lid for closing off the top opening.

* * * * *